US007380351B1

(12) United States Patent
Pavone et al.

(10) Patent No.: US 7,380,351 B1
(45) Date of Patent: Jun. 3, 2008

(54) HELIUM INJECTED FOOTWEAR WITH ADJUSTABLE SHOE SIZE UPPER AND ADJUSTABLE FIRMNESS SOLE

(76) Inventors: Luigi Alessio Pavone, 299 Nakoa Dr., Wailuku, HI (US) 96793-2456; Lori Takako Murakami, 299 Nakoa Dr., Wailuku, HI (US) 96793-2456

( * ) Notice: Subject to any disclaimer, the term of this patent is extended or adjusted under 35 U.S.C. 154(b) by 523 days.

(21) Appl. No.: 10/907,004

(22) Filed: Mar. 16, 2005

(51) Int. Cl.
*A43B 13/20* (2006.01)

(52) U.S. Cl. ..... 36/29; 36/28; 36/88; 36/35 B

(58) Field of Classification Search ..... 36/28, 36/29, 88, 93, 35 B
See application file for complete search history.

(56) References Cited

U.S. PATENT DOCUMENTS 4,183,156 A * 1/1980 Rudy ..... 36/44
4,361,969 A * 12/1982 Vermonet ..... 36/88
5,025,575 A * 6/1991 Lakic ..... 36/44
5,042,176 A * 8/1991 Rudy ..... 36/29
5,113,599 A * 5/1992 Cohen et al. ..... 36/88
5,295,313 A * 3/1994 Lee ..... 36/3 R
5,335,430 A * 8/1994 Fiso et al. ..... 36/88
5,343,638 A * 9/1994 Legassie et al. ..... 36/29
5,625,964 A * 5/1997 Lyden et al. ..... 36/29
5,784,807 A * 7/1998 Pagel ..... 36/93
6,009,637 A * 1/2000 Pavone ..... 36/29
6,014,823 A * 1/2000 Lakic ..... 36/93
6,158,149 A * 12/2000 Rudy ..... 36/29
6,192,606 B1 * 2/2001 Pavone ..... 36/29
6,425,195 B1 * 7/2002 Donzis ..... 36/88
6,557,272 B2 5/2003 Pavone
6,785,985 B2 * 9/2004 Marvin et al. ..... 36/45
6,837,590 B2 * 1/2005 Marston ..... 362/103
7,204,041 B1 * 4/2007 Bailey et al. ..... 36/29

* cited by examiner

*Primary Examiner*—Marie Patterson

(57) ABSTRACT

An improved sole and upper for use with all types of footwear which provides adjustable shoe sizing, adjustable sole firmness for differing activities, allows the wearer to view and touch the technology contained in the footwear, while aiding in the facilitation of exercise and healthful movement, according to the use of the footwear for the purpose of comfortable standing, pleasurable walking, steadier running, safer cross-training, while adding extra comfort for the foot during all activities.

1 Claim, 7 Drawing Sheets

HELIUM INJECTED FOOTWEAR WITH ADJUSTABLE SHOE SIZE UPPER AND ADJUSTABLE FIRMNESS SOLE

DESCRIPTION

1. Field of the Invention

The present invention relates generally to all types of footwear, including casual shoes, dress shoes, athletic shoes and sandals, and specifically to an improved sole and upper and footwear incorporating such soles and uppers.

2. Background of the Invention

The footwear industry has long awaited a solution for the age-old problem of fit. Over time the industry has had to appeal to the masses by coming up with standardized sizes which in general fit most people, but as each human being is an individual, no two people have the same shoe fit, or even no two feet of an individual will have the same fit, and one may even find that same individual will have varying fit from day to day or even within the same day. Thus the problem of fit has plagued the industry, and even more so the consumer, for all time. Other industry solutions have been insoles and various pads and other such additions to help with the fit of a pair of shoes after purchase. Some in the industry have even gone so far as using computers with high technology programs to scan feet and then recommend off the shelf insole inserts for a better fit at an additional price. This overlooks the fact that ready made off the shelf products, although may be an advance over un-enhanced non-custom fit shoes, still could not be the ultimate answer for two different foot sizes or shapes. Also the foot changes shape as real human beings stand and/or move, and along with the temperature of the surroundings, this can and does cause the foot to swell, while the shoe size or insole insert size and shape will remain the same. Wearers need more flexibility for a better fit specific to the time and condition and weather and weight and location and activity. Any change in any of the above factors has an impact on feet. Computer programs do not adjust the recommended off the shelf insole insert for a better fit. Our technology does and at no extra cost to the consumer.

The present invention would solve the problem of fit, not with a seemingly afterthought addition post purchase, but within the shoe itself, with an adjustable inflating/deflating upper which would inflate to cushion the foot by pushing out the lining of the shoe upper to fill the empty spaces between the foot and shoe lining to provide better fit and support. Shoe uppers filled with gasses provide cushioning and resiliency superior to that achievable with just material shoes not just for better fit but also for the safety of the foot. Thus the shoes could be custom fit by the adjustment of the amount of gas mixture according to each individual, each foot, each situation, and so on using a meter injection can or other portable device.

Another problem from the consumer standpoint is to always seem to need a separate pair of shoes for each different activity due to the differing sole firmness needed. The present invention would also solve this problem by enabling the consumer to adjust the firmness of the shoe sole and thus be able to use the same pair of shoes for different activities.

Recently a footwear company has begun to talk about using a computer chip embedded in the shoe to solve fit and sole firmness adjustability. While the idea of using microprocessor chips is intriguing, the practicality and economical aspects are daunting. They forget that in order to adjust the shoes for better fitting or sole firmness, an order from that chip needs to be carried to the part that needs to be adjusted which will entail wire connections to those parts. This would surround the foot in a very unfriendly, if not uncomfortable, environment of interconnecting wires, with the chance of malfunction of the microprocessors and wire connections due to the constant and movement of the footwear and actual electrocution, a very real possibility. Using wiring in footwear construction creates discomfort and is an unfriendly environment for the foot. Using no wiring means that chip is a gimmick and useless. Shoes must be made with soft upper material. Feet are part of a human being's body, not a part of a machine. Changed by time, footwear has been made to accommodate human being's bodies using soft and light material. This could not be achieved using a microprocessor chip and all of the hardware it would involve. The present invention would provide adjustability in the sole firmness without the use of any computer chip or microprocessor or any hardware but with an ergonometric, friendly, comfortable technology utilizing and further improving upon the technologies discussed in U.S. Pat. Nos. 6,009,637, 612,606, and 6,557,272.

Inflation of the shoe sole with a fluidic polymeric compound through a valve has been discussed in some detail in U.S. Pat. Nos. 6,192,606 and 6,557,272 and the advantages of a gas filled sole are well known and are discussed in some detail in a number of patents, such as the discussions in U.S. Pat. Nos. 6,009,637, 6,192,606, and 6,557,272. The present invention is an improvement to the invention disclosed and claimed in U.S. Pat. No. 6,557,272 issued on May 6, 2003 and entitled "Helium Movement Magnetic Mechanism Adjustable Socket Sole". Some of the difficulties associated with the type of soles described in the U.S. Pat. No. 6,557,272 is: 1) the heaviness of the sole due to the magnets, 2) the complexity of the socket, 3) controlling the amount injected of the helium or other inert gas mixture which may be combined with fluidic polymeric material contained in an injection can or other portable device, and 4) the adjustment of the socket sole. The present invention will solve these problems by eliminating the magnets, simplifying the construction of the sole, facilitating the injection of the helium or nitrogen or other inert gas mixture which may be combined with fluidic polymeric material contained in an injection can or other portable device, and improving the adjustment function of the sole.

In recent times there has also been a great leeriness or disbelief of new footwear technology. Perhaps not in the technology in itself but whether or not the footwear the consumer is buying actually contains any of that technology at all. The present invention will provide elastomeric see-through windows along with a see-through mid-sole for the actual viewing of the adjustable sole firmness bladder and the facilitation of the helium movement mechanism technology contained in the sole.

There is a need, therefore, for footwear that will provide adjustable shoe sizing, adjustable sole firmness for differing activities, be less complex and simpler to manufacture, easier to inflate/deflate and be easier to adjust, allows the wearer to view and touch the technology contained in the footwear, all the while aiding in the facilitation of exercise and healthful movement, according to the use of the footwear for the purpose of comfortable standing, pleasurable walking, steadier running, safer cross-training, beside adding extra comfort for the foot during all activities.

SUMMARY OF THE INVENTION

It is an object of the present invention to now divide the "Helium Movement Magnetic Mechanism Adjustable Socket Sole" of the U.S. Pat. No. 6,557,272 into five separate components: (1) the outsole, which in the preferred embodiment of the present invention outwardly looks substantially the same as those found in the industry today, but has an interior with engraved or molded spaces into which would fit the adjustable sole firmness bladder and which in the preferred embodiment of the present invention now has elastomeric see-through pocket windows which correspond to the chambers of the adjustable sole firmness bladder to facilitate the helium gas mixture movement mechanism and through which the inner workings of the present invention could be viewed; (2) the adjustable sole firmness bladder, which adjusts the firmness of the sole by inflation or deflation with a metered injection can of helium or nitrogen or other inert gas mixture which may be combined with fluidic polymeric material via a two way valve accessible through the outer side heel area of the outsole in the preferred embodiment of the present invention and facilitates the wearers' mobility due to the movement of the inert gas mixture which may be combined with fluidic polymeric material by the pressure of the foot from the heel chamber through the chamber connecting tunnels to the lower metatarsal chamber (present in some representations of the invention as shown in FIG. 2C and FIG. 2D) or a plurality of chambers through the chamber connecting tunnels to the ball chamber and then back from the ball chamber through the chamber connecting tunnels to the lower metatarsal chamber through the chamber connecting tunnels to the heel chamber creating a movement sensation with the gas/polymer mixture (helium gas mixture in the preferred embodiment of the present invention) and enhanced by the elastomeric see-through windows to increase the pleasure of walking, running, exercising, hiking, etc.; (3) a clear, semi-rigid but still flexible mid-sole which has substantially the same shape and purpose as currently found in the industry today but has the added feature of being see-through and the additional function of further enhancing the helium movement sensation; (4) the adjustable shoe size bladder, which would assist the wearer in adjusting shoe size by inflation and deflation with the inert gas mixture which may be combined with fluidic polymeric material via a tube connecting to a two way valve at the back heel area of the shoe outsole and thus provide support and cushioning surrounding the whole upper perimeter of the foot and filling in the empty spaces between the shoe upper and the foot to provide a custom fit according to each individual's foot while at the same time adding another layer of protection for the foot; and (5) the nozzle adapter and metered injection can which would facilitate and control the amount of injection of the helium gas or nitrogen gas or other inert gas mixture which may be combined with fluidic polymeric material into the adjustable size bladder and adjustable sole firmness bladder.

DETAILED DESCRIPTION OF THE INVENTION

Figure 1A:
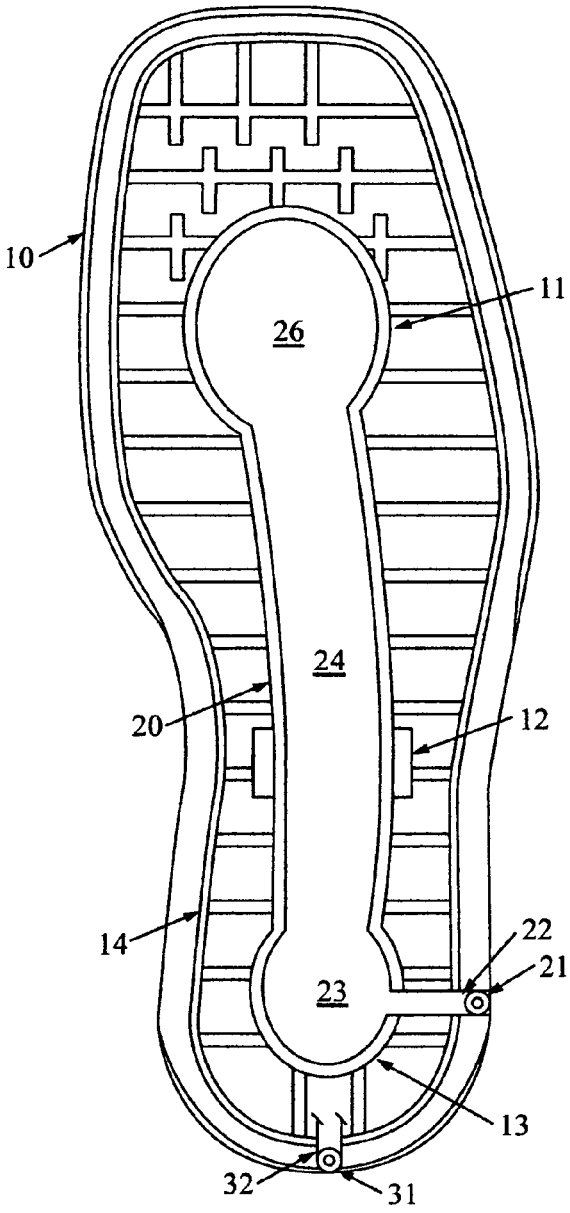
FIG. 1A is a view of the interior of the outsole and one of the embodiments of the adjustable sole firmness bladder and the two-way valve for the adjustable size bladder, the two-way valve for the adjustable sole firmness bladder, and the see-through mid-sole from a top perspective in one of the possible embodiments of the present invention

FIG. 1A shows one of the possible embodiments of the present invention looking from the top at the interior of the outsole and is comprised of an outsole 10, into which is placed the adjustable sole firmness bladder 20, which is comprised of heel chamber 23 (which fits into elastomeric see-through engraved heel pocket window 13 of outsole 10), chamber connecting tunnel 24 which lies over see-through logo window 12, ball chamber 26 (which fits into elastomeric see-through engraved ball pocket window 11 of outsole 10), connected by tube 22 to the adjustable firmness bladder two way valve 21 which is located on the outer lateral heel portion of outsole 10, over all this is placed the flat, clear, semi-rigid but flexible mid-sole 14 made of plastic such as LLDPE, but may be made of other materials having the same characteristics. Also shown in FIG. 1A is the adjustable size bladder two-way valve 31 connected by tube 32 to the adjustable size bladder 30, which is not shown in FIG. 1A.

Figure 1B:
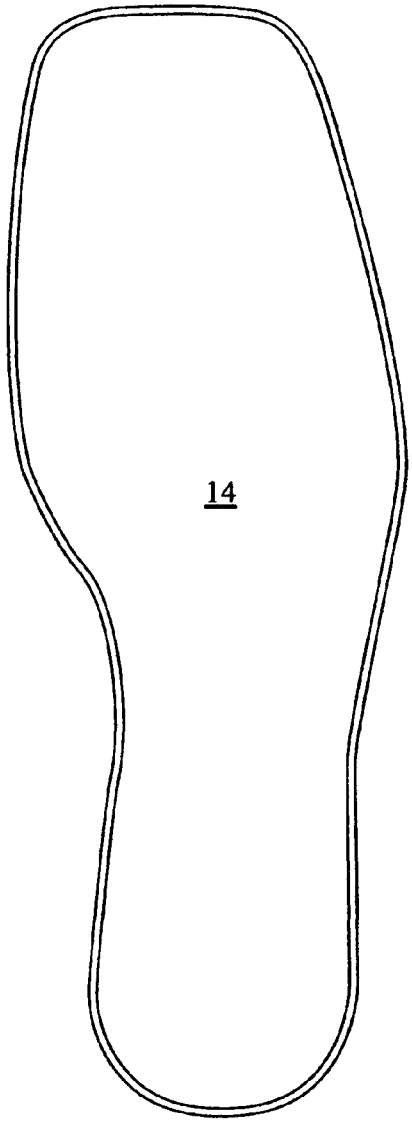
FIG. 1B is the top perspective view of the see-through mid-sole in one of the possible embodiments of the present invention

As shown in FIG. 1B the clear mid-sole 14 is substantially of the same shape and purpose as those found in the industry today and enables the technology (in the form of the adjustable sole firmness bladder 20) to be viewed through the shoe from the elastomeric see-through pocket windows 11, 13 and see-through logo window 12 on the bottom of the outsole 10, through the adjustable sole firmness bladder 20 through the clear mid-sole 14 and finally through a window in the insole, so it may be visible from either the top or bottom of the footwear.

Figure 4A:
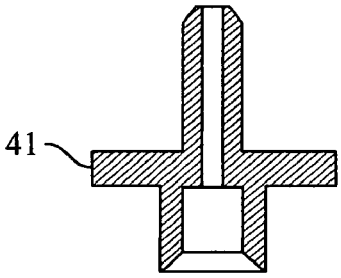
FIG. 4A is the magnified view of the preferred presentation of the nozzle adapter
Figure 4B:
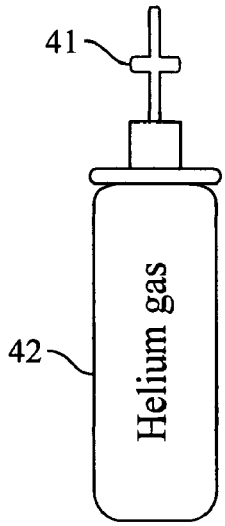
FIG. 4B is the magnified view of the preferred presentation of the nozzle adapter attached to the helium or nitrogen or other inert gas mixture metered injection can
Figure 4C:
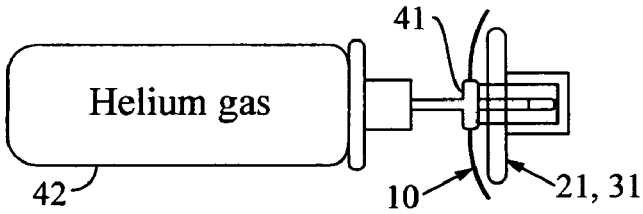
FIG. 4C is the magnified view of the preferred presentation of the nozzle adapter attached to the helium or nitrogen or other inert gas mixture metered injection can and inserted into a two-way valve in the shoe outsole
Figure 5A:
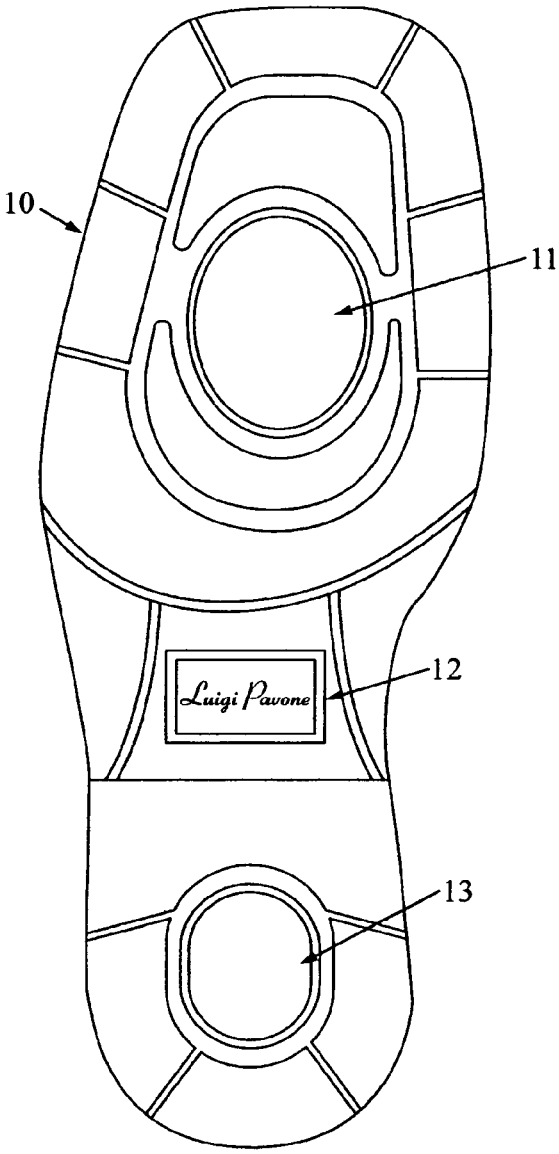
FIG. 5A is the bottom perspective view of the outsole with the elastomeric see-through engraved ball pocket window, see-through logo window, and elastomeric see-through engraved heel pocket window in one of the preferred presentations of the present invention
Figure 5B:
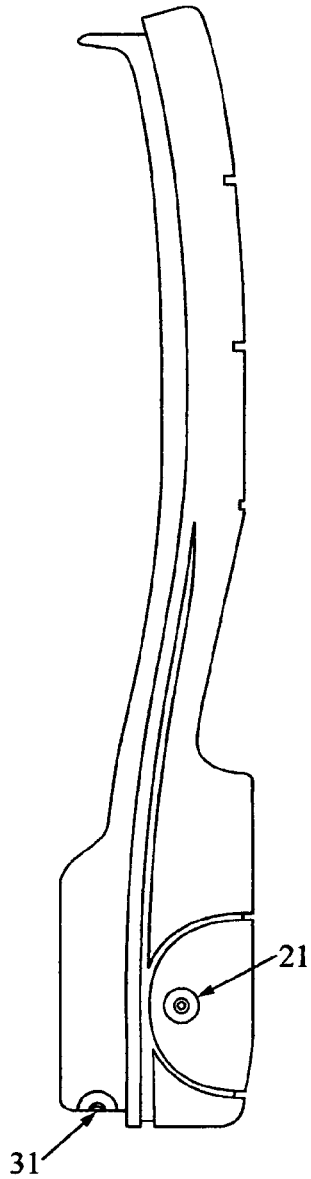
FIG. 5B is the lateral view of the outer showing side of the outsole with the two-way valves for the adjustable size bladder and the adjustable sole firmness bladder in one of the preferred presentations of the present invention
Figure 5C:
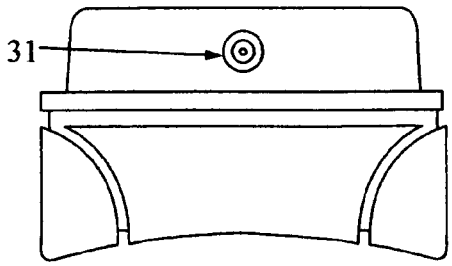
FIG. 5C is a back view of the heel of the shoe outsole with the two-way valve for the adjustable size bladder in one of the preferred presentations of the present invention

FIG. 4A shows a magnified view of the nozzle adapter 41, FIG. 4B shows a magnified view of the preferred presentation of the metered helium or nitrogen or other inert gas mixture injection can 42 with the nozzle adapter 41 attached, FIG. 4C shows a magnified view of the preferred presentation of the metered helium or nitrogen or other inert gas mixture injection can 42 with attached nozzle adapter 41 inserted into the adjustable size bladder/adjustable sole firmness bladder two way valve 21, 31 in outsole 10. The composition, function and benefits of combining the helium or nitrogen or other inert gas with fluidic polymeric compound has been previously described and discussed in the U.S. Pat. Nos. 6,192,606 and 6,557,272. The metered injection can 42 further controls and enables the control of the amount of the helium or nitrogen or other inert gas mixture injected and the prevention of overfilling.

Figure 2A:
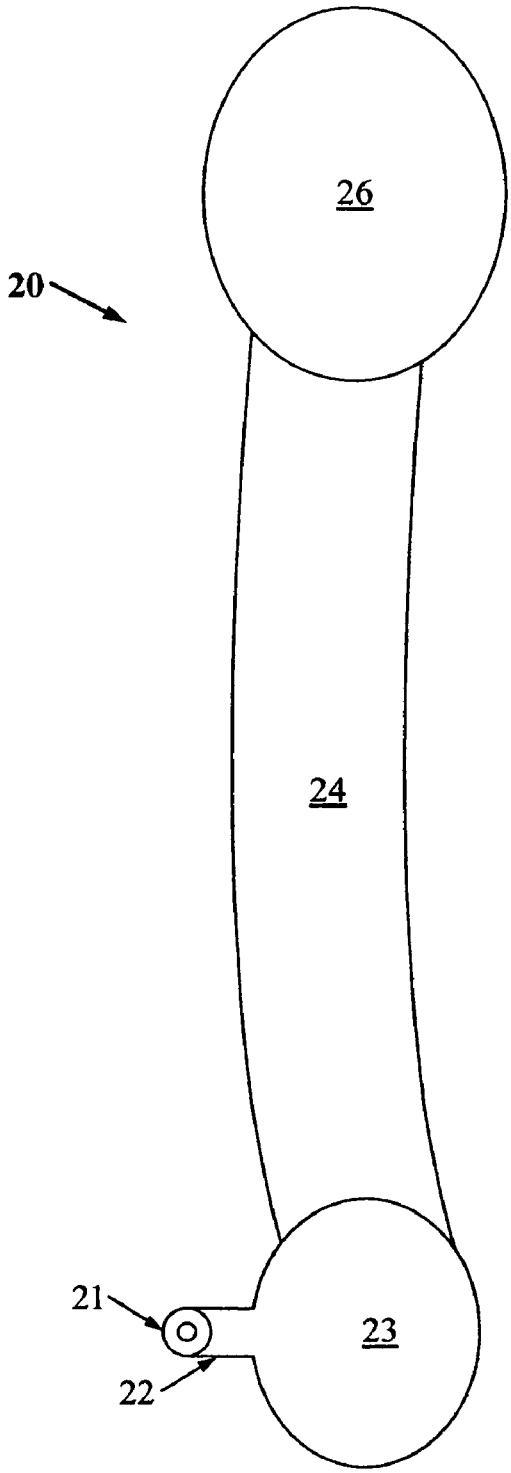
FIGS. 2A and 2C are the bottom perspective views and FIGS. 2B and 2D are the side perspective views of two of the possible embodiments of the adjustable sole firmness bladder with two-way valve of the present invention FIG. 3A in descending order is a lateral view of a shoe upper, the adjustable shoe size bladder with the connecting tube and two-way valve, and the shoe upper lining in one of the preferred presentations of the present invention FIG. 3B in descending order is a lateral view of the shoe upper with adjustable shoe size bladder with connecting tube and two-way valve and shoe upper lining assembled together, and assembled adjustable sole firmness shoe sole with two-way valve
Figure 2B:
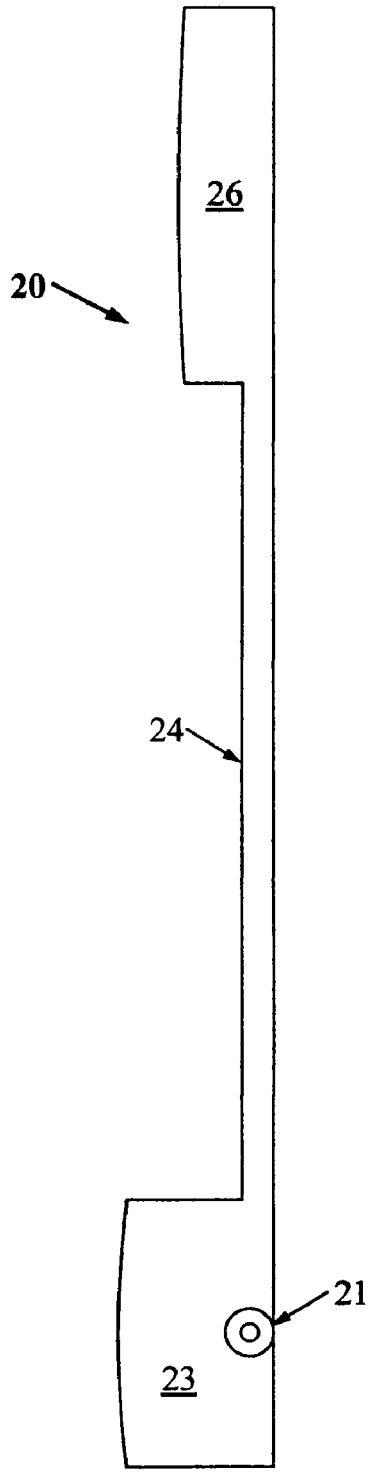
Figure 2C:
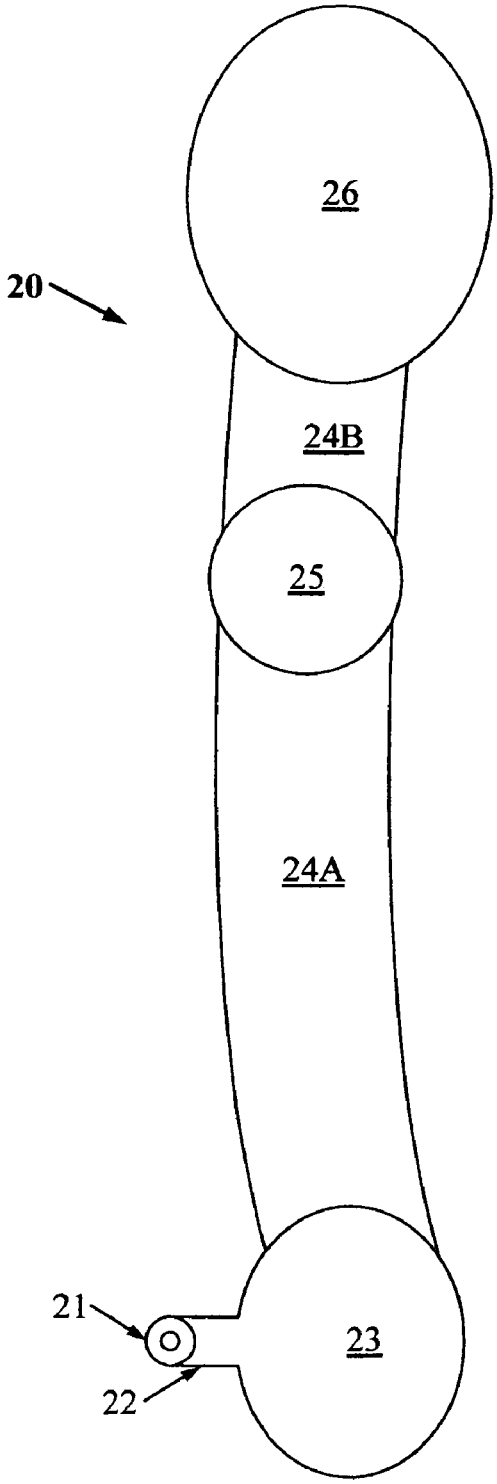
Figure 2D:
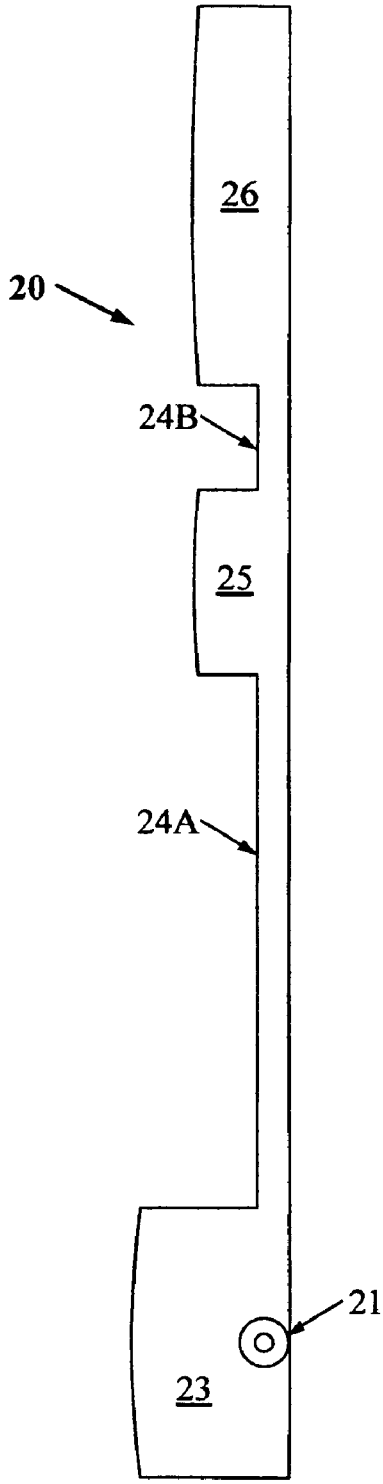

FIGS. 2A and 2C show the bottom perspective images and FIGS. 2B and 2D show the side perspective images of two of the possible embodiments of the adjustable sole firmness bladder 20. When helium or nitrogen or an inert gas mixture, which may be combined with fluidic polymeric material, is inserted from a metered injection can 42 or other portable device with the nozzle adapter 41 via the two way valve 21, it will flow from connecting tube 22 into the adjustable sole firmness bladder 20 and inflate the heel chamber 23, continue to flow through the chamber connecting tunnel 24 or 24A if present, inflate the lower metatarsal chamber 25 if present, continue to flow through the chamber connecting tunnel 24B if present, and inflate the ball chamber 26 causing the chambers to expand and push out the engraved elastomeric see-through pocket windows 11 and 13 each chamber corresponds and fits into. This in turn will increase the firmness of the outsole 10 under the corresponding chamber areas 23, 25 if present, and 26, and as more helium or nitrogen or other inert gas mixture, which may be combined with fluidic polymeric material, is inserted from the metered injection can 42 or other portable device with the nozzle adapter 41 via two way valve 21 or is released via two way valve 21, the firmness of the outsole 10 may be adjusted according to the comfort of the wearer and the activity. Clear mid-sole 14 is positioned over bladder 20 for the added function of preventing the over-expansion of the adjustable sole firmness bladder 20 into the interior of the footwear. While providing adjustability of firmness, the adjustable sole firmness bladder also provides a health aid to the wearer via a healthful massage sensation on the sole of the foot as the pressure of the foot in stride causes the helium or nitrogen or other inert gas mixture, which may be combined with fluidic polymeric material, in each chamber to be pushed through the bladder 20 from chamber 23 to chamber 25 if present to chamber 26 and back again through the chamber connecting tunnels 24 or 24A and 24B if chamber 25 is present as the foot completes each foot strike and continues in stride. This healthful massage sensation is further enhanced and facilitated by the stretching and popping out and subsequent retracting of the elastomeric see-through pocket windows 11 and 13 as the helium or nitrogen or other inert gas mixture, which may be combined with fluidic polymeric material moves through and inflates the chambers 23, 25 if present, and 26 of the bladder 20. The semi-rigid nature of the clear mid-sole 14 enhances and facilitates the helium movement within the adjustable sole firmness bladder 20 by limiting the upward expansion of the heel chamber 23, metatarsal chamber 25 when present, ball chamber 26 of the adjustable sole firmness bladder 20 into the interior of the shoe upper from inflation by the injection of the helium or nitrogen or other inert gas mixture which may be combined with fluidic polymeric material. Then with the initial downward pressure of the foot in motion: initially the heel upon the corresponding area of clear mid-sole 14 would further enhance and facilitate the helium movement mechanism by compressing heel chamber 23 which would in turn further pop out elastomeric heel pocket window 13, continued and further downward pressure of the heel would then flatten elastomeric heel pocket window 13 against the ground and push the helium gas mixture out from heel chamber 23 into and through the channel connecting tunnel 24 to fill and expand ball chamber 26 which would pop out elastomeric ball pocket window 11. With the continued movement of the foot, the ball of the foot would then press down upon the corresponding area of clear mid-sole 14 which would compress ball chamber 26 which would in turn further pop out elastomeric ball pocket window 11, continued pressure of the foot would then flatten elastomeric ball pocket window 11 against the ground and push the helium gas mixture out from ball chamber 26 back into channel connecting tunnel 24 and subsequently back into heel chamber 23. Continued motion of the foot would cause the helium gas mixture movement to cycle again and again as long as the foot remains in motion and thus create the movement mechanism. Certainly it is an easy way to achieve and gain the most benefit of using such footwear for health aid.

Figure 3A:
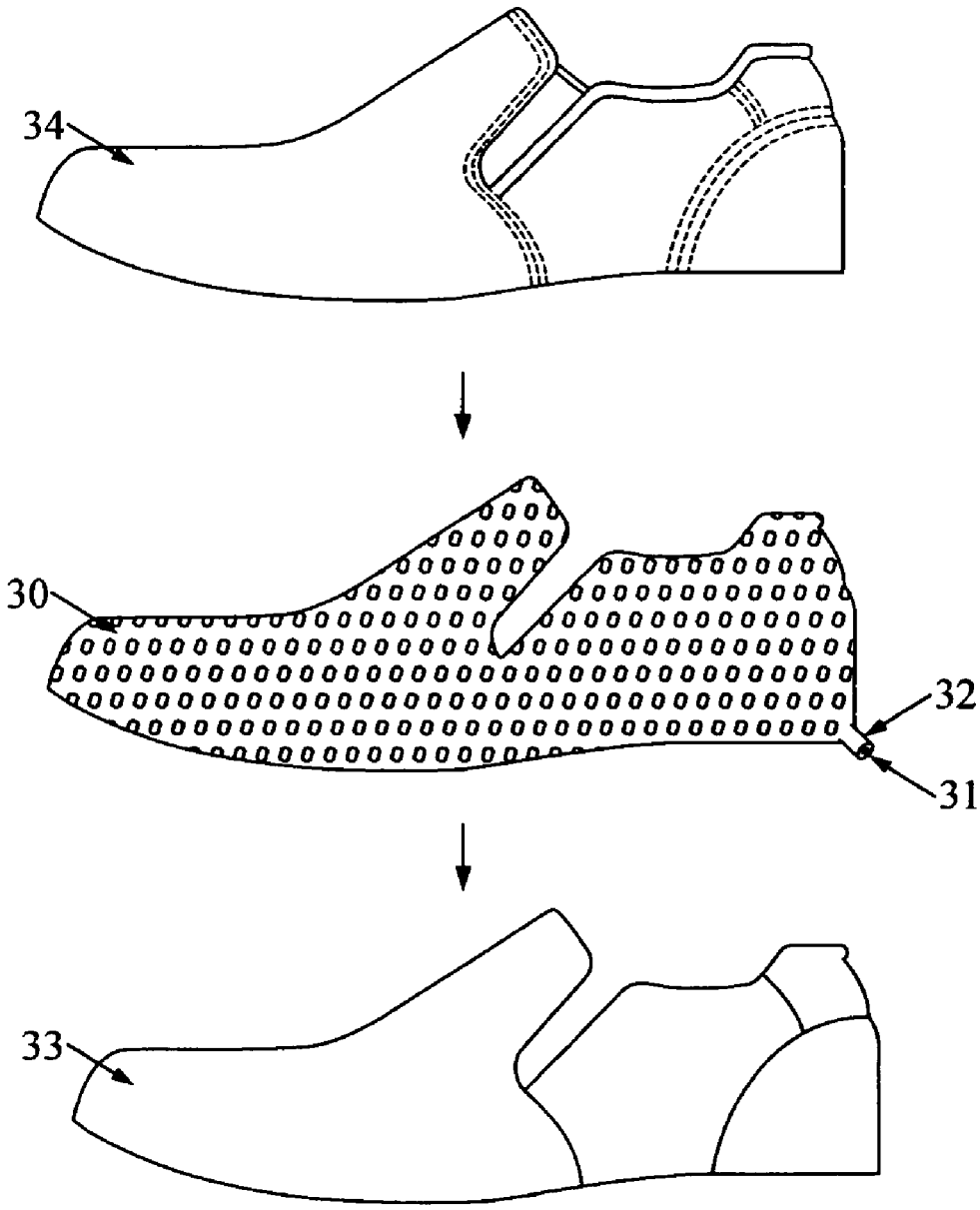
FIG. 3C is a lateral view of the fully assembled shoe with adjustable shoe size upper with two-way valve and adjustable firmness sole with two-way valve
FIG. 3D is a cross sectional view of FIG. 3C assembled shoe upper with adjustable size bladder with connecting tube and two-way valve and shoe lining before inflation
FIG. 3E is a cross sectional view of FIG. 3C assembled shoe upper with adjustable size bladder with connecting tube and two-way valve and shoe lining after inflation
Figure 3B:
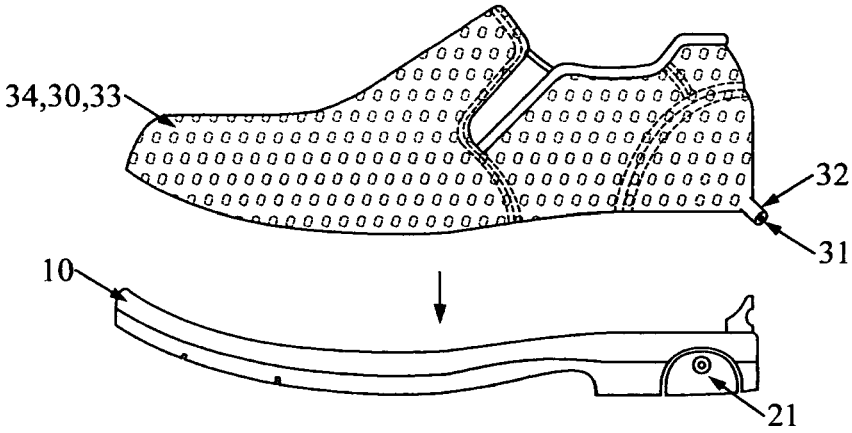
Figure 3C:
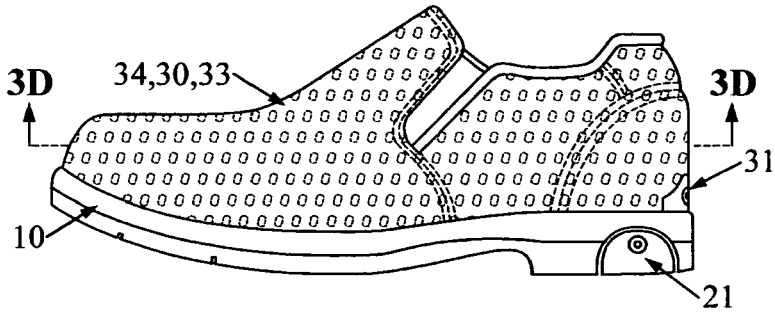
Figure 3D:
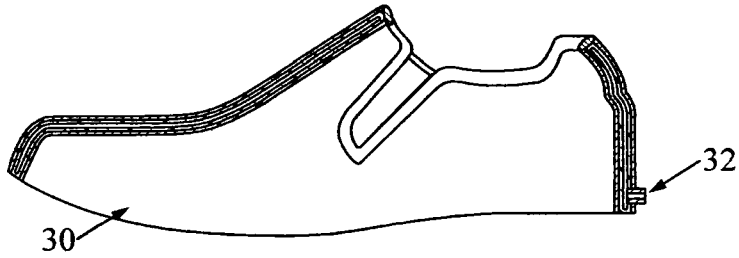
Figure 3E:
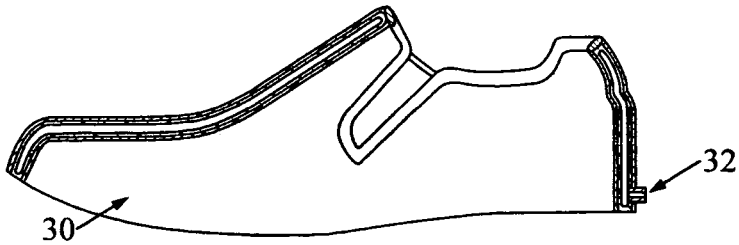

Going on the FIG. 3A the adjustable shoe size bladder 30 can be substantially in the same shape as the shape of the footwear upper 34 and is a bladder-like component made of elastomeric rubber or elastomeric polymer to be sandwiched between the shoe upper material 34 and lining material 33 of the shoe upper. When the adjustable size bladder 30 is injected via two way valve 31 with helium or nitrogen or other inert gas mixture, which may be combined with fluidic polymeric material, from a metered injection can 42 or other portable device with the nozzle adapter 41, the gas mixture will flow through connecting tube 32 and gradually inflate to cushion the foot by pushing out the lining 33 of the shoe upper 34 to fill the empty spaces between the foot and shoe lining 33 to provide better fit and support due to adding another layer of protection. When the foot is inserted into the shoe and puts pressure on the adjustable size bladder 30, each adjustable area will accommodate itself to fill the empty space in that particular area and cushion the foot to provide the ultimate custom fit according to that particular day's conditions (swelling of the foot, weather, etc.). Subsequent movement of the foot in the shoe will cause the helium or nitrogen or other inert gas mixture, which may be combined with fluidic polymeric material to flow in the adjustable shoe size bladder 30 from one area to another depending upon the pressure of the foot at that time and make the footwear fit like a glove.

While the invention has been described herein by way of specific embodiments, it will be understood that the invention may be embodied in other forms.

We claim:

1. A footwear system comprising of:

A metered injection can or any portable device filled with an inert gas mixture combined with fluidic polymeric material to inject:

A. Shoe soles comprising of:

An out sole having a first two-way valve, a second two-way valve, pluralities of elastomeric see-through pocket windows which extend out due to the pressure of gas when the bladder is inflated and shrinks when gas is released, walking on the extended inflated windows creates movement mechanism, a see-through window, an adjustable sole firmness bladder, and a semi-rigid but flexible see-through mid-sole;

Said adjustable sole firmness bladder having a plurality of chambers corresponding to the heel, metatarsal, and ball areas of the foot and in turn corresponding to the elastomeric see-through pocket windows of said outsole, tunnels connecting the chambers, and connecting tube to the first two way valve in said out sole, bladder is filled with the inert gas mixture with the metered injection can or any portable device into the first two way valve by a nozzle adapter attached to the said metered injection can or any device;

B. An adjustable shoe size upper comprising of:

A core formed from an elastomeric rubber or any elastomeric polymer inserted between the footwear upper material and lining;

Said adjustable shoe size core having a connecting tube to the second two way valve in said outsole and inflated through second two way valve with inert gas mixture combined with fluidic polymeric material by a nozzle adapter attached to a metered injection can or other portable device.

* * * * *